US006474501B1

(12) United States Patent
Volpatti

(10) Patent No.: US 6,474,501 B1
(45) Date of Patent: Nov. 5, 2002

(54) AUTOMATIC DISPENSER OF FRESH CUT FLOWERS MAKING BOUQUETS ON REQUEST

(76) Inventor: Mireille Volpatti, Les Terres Hautes, Chemin de Romagona, 83610 Collobrieres (FR)

( * ) Notice: Subject to any disclaimer, the term of this patent is extended or adjusted under 35 U.S.C. 154(b) by 0 days.

(21) Appl. No.: 09/381,471

(22) PCT Filed: Oct. 24, 1997

(86) PCT No.: PCT/FR97/01094

§ 371 (c)(1),
(2), (4) Date: Sep. 21, 1999

(87) PCT Pub. No.: WO99/22347

PCT Pub. Date: May 6, 1999

(51) Int. Cl.[7] ..... G07F 11/00
(52) U.S. Cl. ..... 221/75; 221/135; 221/150 R; 221/155
(58) Field of Search ..... 221/2, 3, 75, 135, 221/150 R, 155

(56) References Cited

U.S. PATENT DOCUMENTS

| | | | | |
|---|---|---|---|---|
| 3,336,773 A | * | 8/1967 | Oechslin | |
| 3,344,953 A | | 10/1967 | Krakauer et al. | |
| 3,653,540 A | | 4/1972 | Offutt | |
| 3,773,217 A | * | 11/1973 | Schlaf | 221/75 |
| 4,954,697 A | * | 9/1990 | Kokubun et al. | 221/3 X |
| 5,415,319 A | * | 5/1995 | Risolia | 221/3 |
| 5,440,479 A | * | 8/1995 | Hutton | |
| 5,564,257 A | * | 10/1996 | Fantz et al. | |
| 5,666,975 A | | 9/1997 | Lord | |
| 5,718,099 A | * | 2/1998 | Fantz et al. | |
| 6,015,224 A | * | 1/2000 | Greenstein | |
| 6,123,223 A | * | 9/2000 | Watkins | 221/155 X |

FOREIGN PATENT DOCUMENTS

| | | |
|---|---|---|
| EP | 0710936 | 5/1996 |
| FR | 1151210 | 1/1958 |
| FR | 2253349 | 6/1975 |
| FR | 2588107 | 4/1987 |
| FR | 2 749 960 | * 12/1997 |
| JP | 5-182074 | 7/1993 |
| WO | 92/00577 | 1/1992 |
| WO | 94/13540 | 6/1994 |
| WO | 95/34225 | 12/1995 |

OTHER PUBLICATIONS

Patent Abstracts of Japan, vol. 017, No. 394 (C–1088) issued Jul. 1993.
An English Language abstract of FR 2 588 107.

* cited by examiner

*Primary Examiner*—David H. Bollinger
(74) *Attorney, Agent, or Firm*—Greenblum & Bernstein, P.L.C.

(57) ABSTRACT

Automatic dispenser of natural flowers which is adapted to making bouquets on request by a user comprising a structure for storing and preserving several series of natural flowers. The structure comprises a transparent part which allows the user to view and select the natural flowers, from outside the structure, when the natural flowers are disposed inside the structure. An external control panel is provided. A coin operated meter is provided which is adapted to receive coins from the user. An internal selection mechanism is provided and is controlled by the external control panel. The internal selection mechanism is adapted to enable the user to individually select each of the natural flowers. A unit for packaging and wrapping the flowers into a bouquet is also provided. The unit is adapted to form the bouquet from the natural flowers selected by the user.

20 Claims, 1 Drawing Sheet

AUTOMATIC DISPENSER OF FRESH CUT FLOWERS MAKING BOUQUETS ON REQUEST

CROSS-REFERENCE TO RELATED APPLICATIONS

The present application is a National Stage Application of International Application No. PCT/FR97/01904, filed Oct. 24, 1997.

BACKGROUND OF THE INVENTION

1. Field of the Invention

The present invention is directed to an automatic dispenser of fresh cut flowers making bouquets on request.

It is designed to be installed in various public places, such as railway concourses, airports, hospitals, and the like, or in the proximity of a florist's shop to enable it to continue sales after opening hours.

2. Discussion of Background Information

Automatic dispensers are increasingly widespread. They enable multiplying points of sale and increasing the marketing period of the products presented without mobilizing personnel, the cost of which is increasingly high in developed countries.

They give users the capability of procuring an increasingly large range of varied products at any time, ranging from candy to bread, and including cigarettes, hot or cold beverages, or toys.

To our knowledge, there are currently no fresh flower dispensers enabling freely selecting the composition of a bouquet. It is, however, certain that numerous individuals wanting to buy flowers, in particular to offer them to someone, must forego doing so because shops are either closed or do not exist. It is also certain that the presence of a dispenser in an appropriate location can prompt individuals who had not so planned to buy a bouquet.

Patent No. FR 2 588 107 filed on Apr. 11, 1985 by Mr. NERACOULIS (forfeited on Dec. 31, 1986) describes an insulated refrigerated enclosure of which the front comprises two superposed glass windows, adapted for automatic dispensing, using a payment means, of natural cut flowers wrapped singly or in bouquets. The flowers are presented in compartments arranged around the periphery of a drum and forming a barrel enabling viewing of the products. Extraction of the wrapped flowers is accomplished by means of an automatically retractable flap, with a selection control enabling choosing, from among the products presented, the one desired.

This apparatus, which appears not to have been developed, presents several disadvantages. In particular, the arrangement of the flowers on a drum enables seeing only part of the products available at one time. Above all, it is completely impossible to put together a bouquet according to one's imagination and means.

SUMMARY OF THE INVENTION

The device according to the present invention has as its objective the remedying of this state of affairs. It enables, in effect, producing and individualizing one's own bouquet on request and adapting the selection to the financial need of the clientele.

The invention provides for an apparatus comprising a storage and preserving structure capable of housing several series of various fresh cut flowers and arranged such that at least one flower of each series can be seen from outside, an external control mechanism associated with a coin operated meter enabling selection of these flowers individually and conveying them towards a unit for packaging the bouquet thus created in extensible individual packages or using a transparent film roll.

The invention provides for an automatic dispenser of natural flowers which is adapted to making bouquets on request by a user, comprising a structure for storing and preserving several series of natural flowers, the structure comprising a transparent part which allows the user to view and select the natural flowers, from outside the structure, when the natural flowers are disposed inside the structure, an external control panel, a coin operated meter which is adapted to receive coins from the user, an internal selection mechanism controlled by the external control panel, the internal selection mechanism being adapted to enable the user to individually select each of the natural flowers, and a unit for packaging and wrapping the flowers into a bouquet, wherein the unit is adapted to form the bouquet from the natural flowers selected by the user.

The flower dispenser may further comprise at least one mechanism for guiding each of the natural flowers to the packaging and wrapping unit. The flower dispenser may further comprise a mechanism for holding the natural flowers. The mechanism for holding the natural flowers may comprise at least one rotating spiral. The at least one rotating spiral may comprise at least two synchronized rotating spirals which are adapted for holding and moving the natural flowers horizontally. The unit for packaging and wrapping the bouquet may comprise one of a supply of transparent film and a roll of transparent film. The flower dispenser may further comprise a plurality of natural flowers arranged within the structure and each of the natural flowers may comprise a mechanism containing water which is adapted to be mounted on each stem of each natural flower. The structure may be adapted to preserve the natural flowers during storage using one of water and refrigeration. The control panel may comprise one of an audio data announcing device and Braille imprinted control keys.

The invention also provides for an automatic dispenser of flowers which is adapted to making bouquets on request by a user, comprising a cabinet structure for storing and preserving a plurality of flowers. The cabinet structure comprise a transparent part which allows the user to view and select the flowers, from outside the cabinet structure, when the natural flowers are disposed inside the structure. An external control panel is adapted to allow the user to select the flowers and a mechanism is provided for receiving payment from the user. An internal selection mechanism is controlled by the external control panel, the internal selection mechanism being adapted to enable the user to individually select each of the flowers, and a unit for packaging the flowers into a bouquet, wherein the unit is adapted to form the bouquet from the flowers selected by the user.

The unit for packaging may comprise a mechanism for wrapping the flowers in film. The flower dispenser may further comprise a mechanism for holding the flowers. The mechanism for holding the flowers may comprise at least one rotating spiral. The at least one rotating spiral may comprise at least two synchronized rotating spirals which are adapted for holding and moving the flowers horizontally. The unit for packaging the flowers into the bouquet may comprise one of a supply of transparent film and a roll of transparent film. The flower dispenser may further comprise a plurality of flowers arranged within the cabinet structure and each of the flowers may comprise a mechanism containing water which is adapted to be mounted on each stem of each flower. The cabinet structure may be adapted to preserve the flowers during storage using one of water and refrigeration. The control panel may comprise one of an audio data announcing device and Braille imprinted control keys.

The invention further provides for an automatic dispenser of flowers which is adapted to making bouquets on request by a user, comprising a cabinet structure for storing and preserving a plurality of flowers. The cabinet structure comprises a transparent part which allows the user to view and select the flowers, from outside the cabinet structure, when the natural flowers are disposed inside the structure. An external control panel is adapted to allow the user to select the flowers and there being provided a mechanism for receiving payment from the user. An internal selection mechanism is controlled by the external control panel, the internal selection mechanism being adapted to enable the user to individually select each of the flowers. A unit for wrapping the flowers with a film to form a bouquet is provided, the unit being adapted to form the bouquet from the flowers selected by the user, and a mechanism is provided for holding the flowers, wherein the mechanism for holding the flowers comprises at least one rotating spiral.

The at least one rotating spiral may comprise at least two synchronized rotating spirals which are adapted for holding and moving the flowers horizontally.

BRIEF DESCRIPTION OF THE DRAWINGS

In the attached drawings, there is provided by way of nonrestrictive example one of the embodiments of the object of the invention.

DETAILED DESCRIPTION OF THE INVENTION

Figure 1:
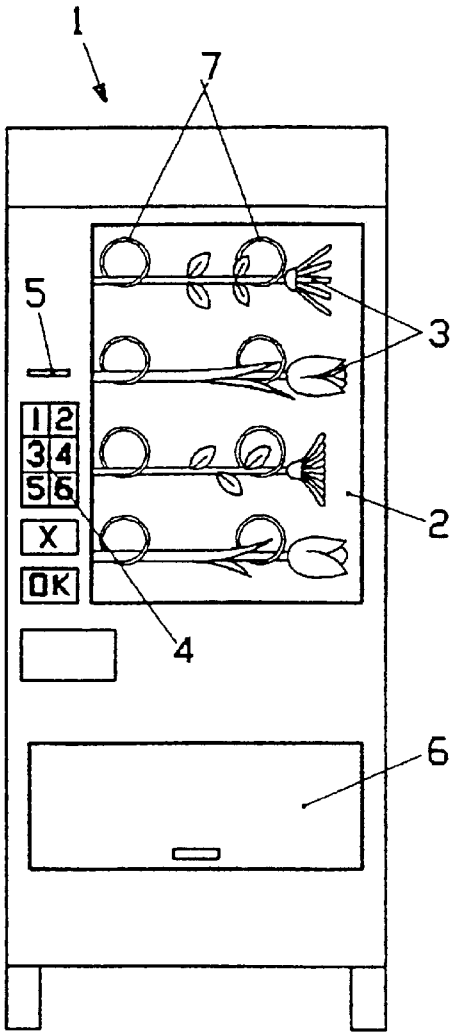
FIG. 1 depicts a front elevation of a bouquet dispenser.
Figure 2:
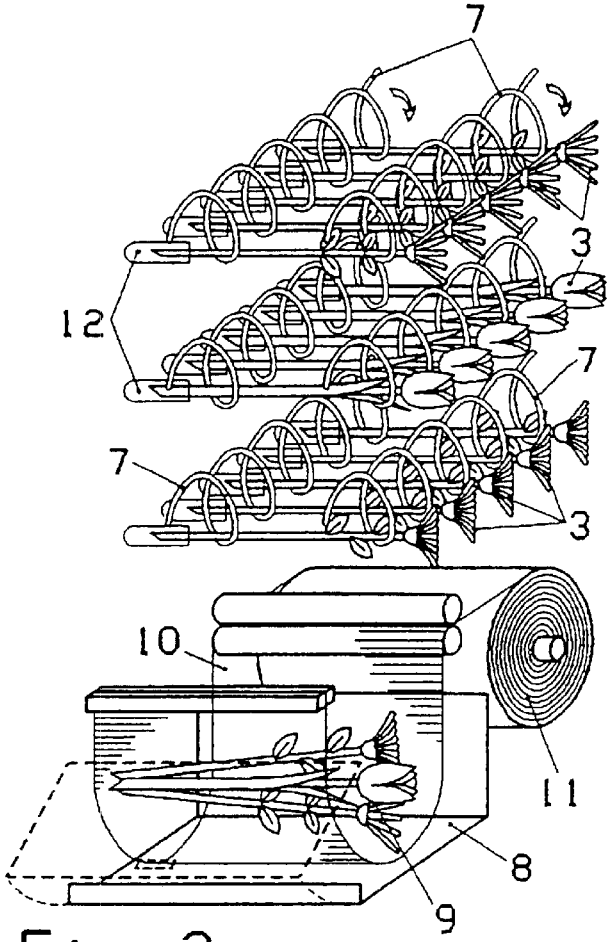
FIG. 2 is a schematic isometric view depicting one of the possible embodiments of the device.

The device of FIGS. 1 and 2, provides for a cabinet 1 similar in appearance to that of current automatic dispensers of candy and similar products, preferably made of painted or stainless steel, and comprising a transparent part 2 permitting viewing the flowers 3 stored inside, as well as an outside control panel 4 with a coin operated meter 5 enabling control of an internal selection mechanism. A flap 6, or a drawer, enables taking possession of the bouquet 9 (see FIG. 2) once it is duly wrapped.

In the example illustrated, the selection mechanism, which simultaneously ensures storage, is made up of a set of rotatable spirals 7 with horizontal axes perpendicular to the front face of the cabinet 1, at a rate of two (or more) synchronized spirals per series of identical flowers, arranged to release one flower once they have completed a revolution, while also advancing the flowers in reserve located behind, such that the one which will be released with the next maneuver is always located at the front and is visible.

The flowers selected and released individually fall into a receptacle 8 where they are packaged as a bouquet 9 and wrapped in a transparent film 10 supplied by a roll 11, due to a mechanism of a known type, common in the packaging industry and not described here.

As soon as the wrapping is finished, the opening of the flap 6, normally prohibited, is released.

Figure 3:
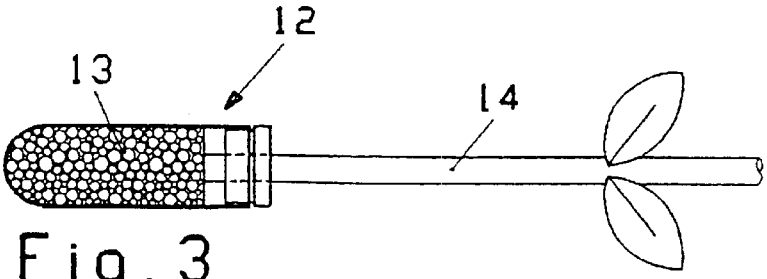
FIG. 3 is an enlarged view of a water supply tube with foam mounted on the stem of the flowers to ensure their preservation.

To ensure preservation of the flowers 3 during storage, a small tube 12 containing foam 13 soaked with water can be slipped onto each of the stems 14 (FIG. 3). These latter are advantageously cut at the time of packaging as a bouquet 9, so as to eliminate the tubes.

Preservation may also be ensured by possibly periodic spraying of water.

According to a variant embodiment, the flowers 3 are stored vertically. In this case, it is possible to provide water trays in which the end of the stems 14 soak.

The storage will be refrigerated if the environment so requires.

Selection and storage can be effected by various systems, provided that the flowers 3 can be released individually on request. It is possible, for example, to use inclined rods, alveolate drums constituting an endless chain, or any systems used in known dispensers.

The flowers may be stored vertically in a horizontal chute, held by a rotating spiral 7 or a plurality of superposed spirals, and guided individually by a tube which diverts them into a chute where they are vibrated and then wrapped.

In particular, when the flowers are stored in a vertical position, the wrapping of the bouquet 9 can be performed by way of individual extensible bags of folded paper, preferably presented in the form of stackable cones.

The fresh cut flowers will be selected as a function of the region, the season, and local production. They will be calibrated to a stem length on the order of 30 cm, and those of which the flower bud has a diameter exceeding a certain value, for example, 10 cm will be eliminated. Thomas and leaves will be removed from the stems in advance.

As an indication, the system may be designed to store five categories each comprising 20 flowers and to make bouquets of a maximum of 21 flowers.

The coin operated meter 5 may advantageously be supplemented by a payment card reader, and the control panel 4 may comprise a lighted and possibly audio data posting device, a voice control system, and/or Braille imprinted control keys.

The positioning of the various constituent elements gives the object of the invention useful results which have not been obtained, to date, by similar devices.

What is claimed is:

1. An automatic dispenser of natural flowers which is adapted to make bouquets on request by a user, comprising:

a structure for storing and preserving several series of natural flowers;

the structure comprising a transparent part which allows the user to view and select the natural flowers, from outside the structure, when the natural flowers are disposed inside the structure;

an external control panel;

a coin operated meter which is adapted to receive coins from the user;

an internal selection mechanism controlled by the external control panel, the internal selection mechanism being adapted to enable the user to individually select each of the natural flowers; and a unit for packaging and wrapping the flowers into a bouquet, wherein the unit is adapted to form the bouquet from the natural flowers selected by the user.

2. The automatic dispenser of claim 1, further comprising at least one mechanism for guiding each of the natural flowers to the packaging and wrapping unit.

3. The automatic dispenser of claim 1, further comprising a mechanism for holding the natural flowers.

4. The automatic dispenser of claim 3, wherein the mechanism for holding the natural flowers comprises at least one rotating spiral.

5. The automatic dispenser of claim 4, wherein the at least one rotating spiral comprises at least two synchronized rotating spirals which are adapted for holding and moving the natural flowers horizontally.

6. The automatic dispenser of claim 1, wherein the unit for packaging and wrapping the bouquet comprises one of a supply of transparent film and a roll of transparent film.

7. The automatic dispenser of claim 1, further comprising a plurality of natural flowers arranged within the structure, each of the natural flowers comprising a mechanism containing water which is adapted to be mounted on each stem of each natural flower.

8. The automatic dispenser of claim 1, wherein the structure is adapted to preserve the natural flowers during storage using one of water and refrigeration.

9. The automatic dispenser of claim 1, wherein the control panel comprises one of an audio data announcing device and Braille imprinted control keys.

10. An automatic dispenser of flowers which is adapted to make bouquets on request by a user, comprising:

a cabinet structure for storing and preserving a plurality of flowers;

the cabinet structure comprising a transparent part which allows the user to view and select the flowers, from outside the cabinet structure, when the natural flowers are disposed inside the structure;

an external control panel adapted to allow the user to select the flowers;

a mechanism for receiving payment from the user;

an internal selection mechanism controlled by the external control panel, the internal selection mechanism being adapted to enable the user to individually select each of the flowers; and a unit for packaging the flowers into a bouquet, wherein the unit is adapted to form the bouquet from the flowers selected by the user.

11. The automatic dispenser of claim 10, wherein the unit for packaging comprises a mechanism for wrapping the flowers in film.

12. The automatic dispenser of claim 10, further comprising a mechanism for holding the flowers.

13. The automatic dispenser of claim 12, wherein the mechanism for holding the flowers comprises at least one rotating spiral.

14. The automatic dispenser of claim 13, wherein the at least one rotating spiral comprises at least two synchronized rotating spirals which are adapted for holding and moving the flowers horizontally.

15. The automatic dispenser of claim 10, wherein the unit for packaging the flowers into the bouquet comprises one of a supply of transparent film and a roll of transparent film.

16. The automatic dispenser of claim 10, further comprising a plurality of flowers arranged within the cabinet structure, each of the flowers comprising a mechanism containing water which is adapted to be mounted on each stem of each flower.

17. The automatic dispenser of claim 10, wherein the cabinet structure is adapted to preserve the flowers during storage using one of water and refrigeration.

18. The automatic dispenser of claim 10, wherein the control panel comprises one of an audio data announcing device and Braille imprinted control keys.

19. An automatic dispenser of flowers which is adapted to make bouquets on request by a user, comprising:

a cabinet structure for storing and preserving a plurality of flowers;

the cabinet structure comprising a transparent part which allows the user to view and select the flowers, from outside the cabinet structure, when the natural flowers are disposed inside the structure;

an external control panel adapted to allow the user to select the flowers;

a mechanism for receiving payment from the user;

an internal selection mechanism controlled by the external control panel, the internal selection mechanism being adapted to enable the user to individually select each of the flowers;

a unit for wrapping the flowers with a film to form a bouquet, the unit being adapted to form the bouquet from the flowers selected by the user; and a mechanism for holding the flowers, wherein the mechanism for holding the flowers comprises at least one rotating spiral.

20. The automatic dispenser of claim 19, wherein the at least one rotating spiral comprises at least two synchronized rotating spirals which are adapted for holding and moving the flowers horizontally.

* * * * *